US008733063B2

(12) United States Patent
Song et al.

(10) Patent No.: US 8,733,063 B2
(45) Date of Patent: May 27, 2014

(54) FLEXIBLE FLOOR MEMBER WITH A SURFACE DECLINATION AND BEVELED EDGES

(75) Inventors: Jincheng Song, Zhangjiagang (CN); Zhiming Wang, Zhangjiagang (CN); Qingfeng Lu, Zhangjiagang (CN)

(73) Assignee: Tower IPCO Company Limited, Dublin (IE)

( * ) Notice: Subject to any disclaimer, the term of this patent is extended or adjusted under 35 U.S.C. 154(b) by 0 days.

(21) Appl. No.: 13/349,179

(22) Filed: Jan. 12, 2012

(65) Prior Publication Data

US 2013/0086862 A1 Apr. 11, 2013

(30) Foreign Application Priority Data

Oct. 9, 2011 (CN) ..... 2011 1 0305551

(51) Int. Cl.
*E04B 1/00* (2006.01)
*E04F 15/02* (2006.01)

(52) U.S. Cl.
CPC ..... *E04F 15/02* (2013.01)
USPC ..... 52/745.19; 52/390; 52/311.1

(58) Field of Classification Search
USPC ..... 52/177, 311.1, 390, 392, 591.4, 592.4, 52/384, 389, 745.19; D25/157, 138, 119, D25/121, 140, 113, 151, 153, 159
See application file for complete search history.

(56) References Cited

U.S. PATENT DOCUMENTS

| | | | | |
|---|---|---|---|---|
| 604,325 | A * | 5/1898 | Hopkins et al. | 52/392 |
| 2,111,003 | A * | 3/1938 | Petty | 52/603 |
| 6,694,682 | B2 * | 2/2004 | Fanti | 52/177 |
| 7,676,995 | B2 * | 3/2010 | Vanderhoef | 52/177 |
| 7,891,149 | B2 * | 2/2011 | Turner et al. | 52/385 |
| 8,156,710 | B1 * | 4/2012 | Pien | 52/788.1 |
| 8,365,488 | B2 * | 2/2013 | Chen | 52/311.1 |

* cited by examiner

*Primary Examiner* — William Gilbert
*Assistant Examiner* — Gisele Ford
(74) *Attorney, Agent, or Firm* — Rodman & Rodman

(57) ABSTRACT

The floor member, in one embodiment of the invention, is a floor member unit having a surface declination at the periphery of a top surface and extending downwardly to a peripheral beveled edge, and intersecting with the beveled edge between the top surface and a bottom surface. The surface declination can be curved or uncurved. In another embodiment of the invention the floor member unit is laminated in offset relationship to an underlayer of the same size and shape as the floor member unit. In either embodiment, the floor member can be formed as a floor tile or a floor plank.

19 Claims, 9 Drawing Sheets

FLEXIBLE FLOOR MEMBER WITH A SURFACE DECLINATION AND BEVELED EDGES

BACKGROUND OF THE INVENTION

1. Field of the Invention

This invention is directed to a flexible floor member with a peripheral surface declination and peripheral beveled edges, and a method of covering a floor surface. The invention is applicable to flexible floor tiles and flexible floor planks, individually bondable to a floor base, or installed as floating floor members that are not bonded to a floor base.

2. Related Prior Art

It is known to make non-ceramic tiles with rounded edges as shown in U.S. Pat. Nos. 4,772,500 and 7,550,192. The rounded edges are made in a combined cutting and forming operation using a cutting tool that must be replaced when the cutting edge becomes dull. The cutting and forming operation also requires application of a relatively large force and elevated temperatures to form the rounded edge of the tile.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
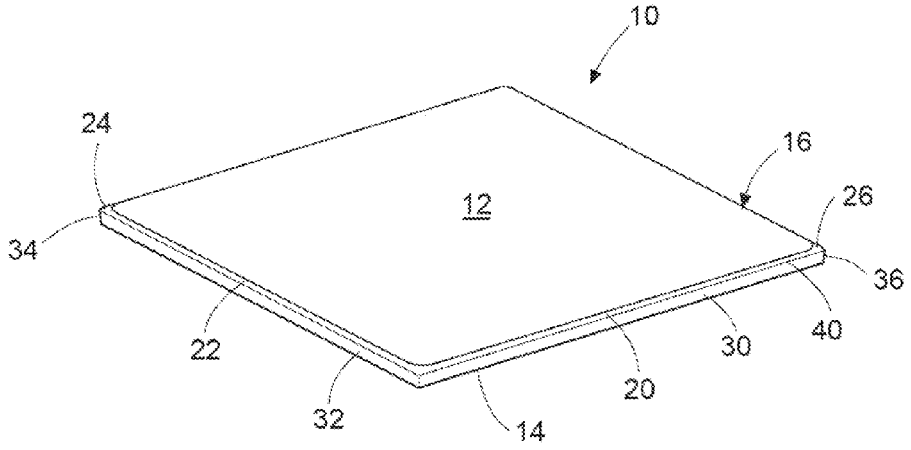
FIG. 1 is a perspective view of a floor tile incorporating one embodiment of the present invention.

Referring to the drawings, a flexible floor member incorporating one embodiment of the invention is generally indicated by the reference number 10 in FIG. 1.

The floor member 10, in this embodiment, is a square tile having a horizontal top surface 12, a bottom surface 14 and a peripheral edge 16. The horizontal top surface 12 is for walking upon and the bottom surface 14 is for receiving a bonding material.

Figure 10A:
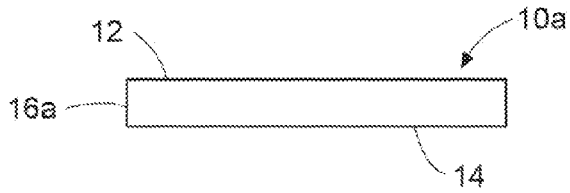
FIG. 10A is a simplified sectional view of a tile blank before it is provided with surface declinations and beveled edges.
Figure 10B:
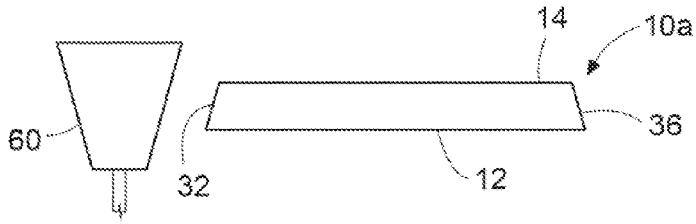
FIG. 10B is a view similar to FIG. 10A in an upside down position during beveling.

The peripheral edge 16 of the tile 10, at the horizontal top surface 12, has rounded edge portions or rounded surface declinations 20, 22, 24 and 26. The rounded surface declinations 20, 22, 24 and 26 extend from the horizontal top surface 12 and gradually decline below the horizontal top surface 12 a distance of approximately ¼ to ⅓ the thickness of the tile 10 between the top surface 12 and the bottom surface 14 (FIG. 10D). The rounded surface declinations extend the full length of each side of the tile 10.

The rounded surface declinations 20, 22, 24 and 26 have an arc radius of approximately 4 mm to 5 mm. However other curved profiles, not necessarily circular, of suitable size and curvature can be used to establish the rounded surface declinations 20, 22, 24 and 26.

The peripheral edge 16 of the tile 10 also includes beveled edge portions 30, 32, 34 and 36 that extend the full length of each side of the tile. Each of the beveled edge portions 30, 32, 34 and 36 diverge upwardly from the bottom surface 14 of the tile 10 toward the top surface 12 and intersect the rounded surface declinations 20, 22, 24 and 26 at an intersection line 40 between the horizontal top surface 12 and the bottom surface 14.

Figure 10C:
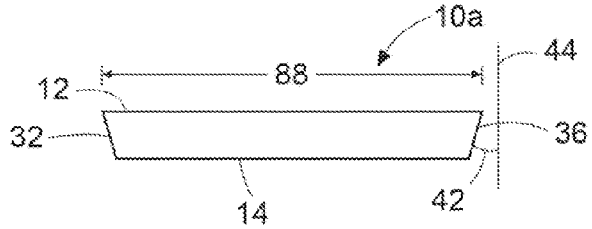
FIG. 10C is a view similar to FIG. 10B in a right side up position after beveling.
Figure 10D:
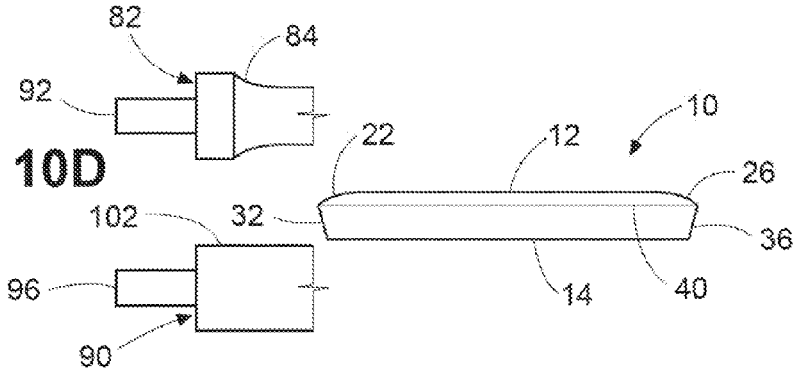
FIG. 10D is a view similar to FIG. 10C with a roller assembly in exploded simplified schematic fragmentary form for forming rounded surface declinations on the tile.

The beveled edge portions 30, 32, 34 and 36 have an angle of divergence 42 of approximately 5 to 35° as measured, for example, from a vertical axis 44 (FIG. 10C).

Figure 13A:
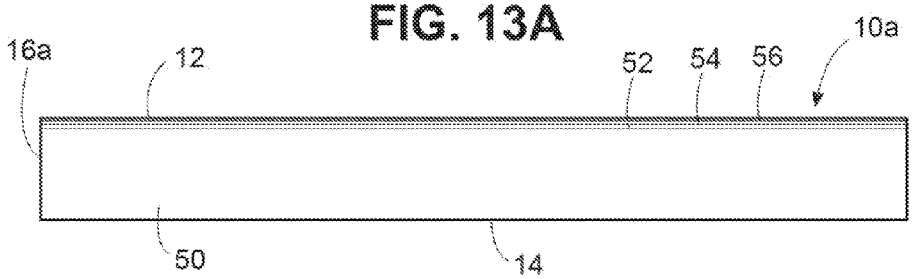
Figure 13B:
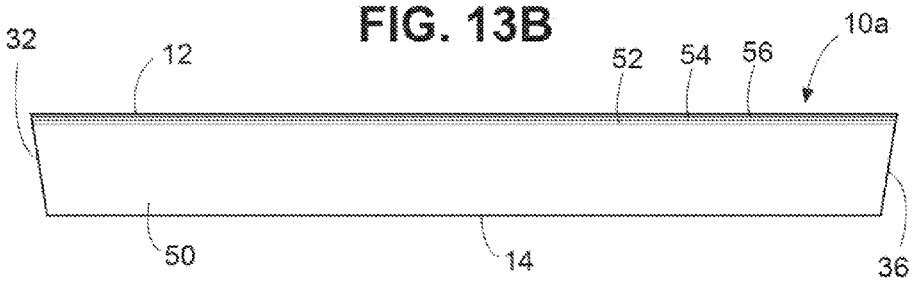
Figure 13C:
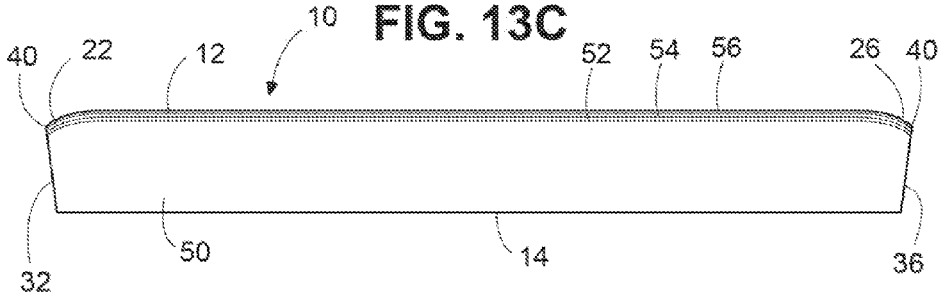

Referring to FIG. 13C the tile 10 has base layer 50, a design layer or design film 52, a transparent wear layer 54 and a top coat 56.

The base layer 50 comprises a formulation of PVC resin, stabilizer, plasticizer and other additives well known to those in the art. The design layer or printing film 52 comprises a formulation of PVC resin and pigments well known to those in the art, and is provided with any selected design.

The transparent wear layer 54 comprises a formulation of PVC resin, stabilizer, plasticizer and other additives, well known to those in the art.

The top coat 56 comprises a formulation of urethane, acrylic oligomers and nano-ceramic bead well known to those in the art.

The floor tile 10 has an overall thickness between the top surface 12 and the bottom surface 14 of approximately 2 mm to 5 mm, for example, although other suitable thicknesses can be used as well in accordance with selected layer thicknesses for the layers 50, 52, 54, 56.

For example the base layer 50 can be, for example, approximately 1.5 mm to 2.0 mm thick. The design layer 52 can be, for example, approximately 0.07 mm thick. The transparent wear layer 54 can be, for example, approximately 0.07 mm to 0.10 mm thick. The top coat layer 56 can be, for example, approximately 0.02 mm thick.

It should be noted that the rounded surface declinations 20, 22, 24 and 26 include the top coat 56, the transparent layer 54 and the design layer 52, as most clearly shown at the rounded surface declinations 22 and 26 of FIG. 13C.

The floor tile 10 is formed from a square tile blank 10*a* (FIG. 10A) having an unbeveled peripheral edge 16*a*. The tile blank 10*a* (FIG. 13A) also includes the horizontal top surface 12, the bottom surface 14, the base layer 50, the design layer 52, the transparent wear layer 54 and the top coat 56.

The unbeveled peripheral edge 16*a* of the tile blank 10*a* (FIG. 10B) is beveled in any suitable known manner, such as with a suitable known conventional grinding system.

Preferably the beveling operation is formed with the tile blank 10*a* in an upside down position as shown in FIG. 10B. Opposite edge portions 32 and 36 can beveled simultaneously in a first grinding operation and the remaining opposite edge portions 30 and 34 can be beveled simultaneously in a second grinding operation.

One example of a grinding tool for the beveling operation is a conical grinding tool 60 (FIG. 10B) having a vertex angle that provides the desired angle of divergence 42 (FIG. 10C) for the tile 10*a*.

Figure 11:
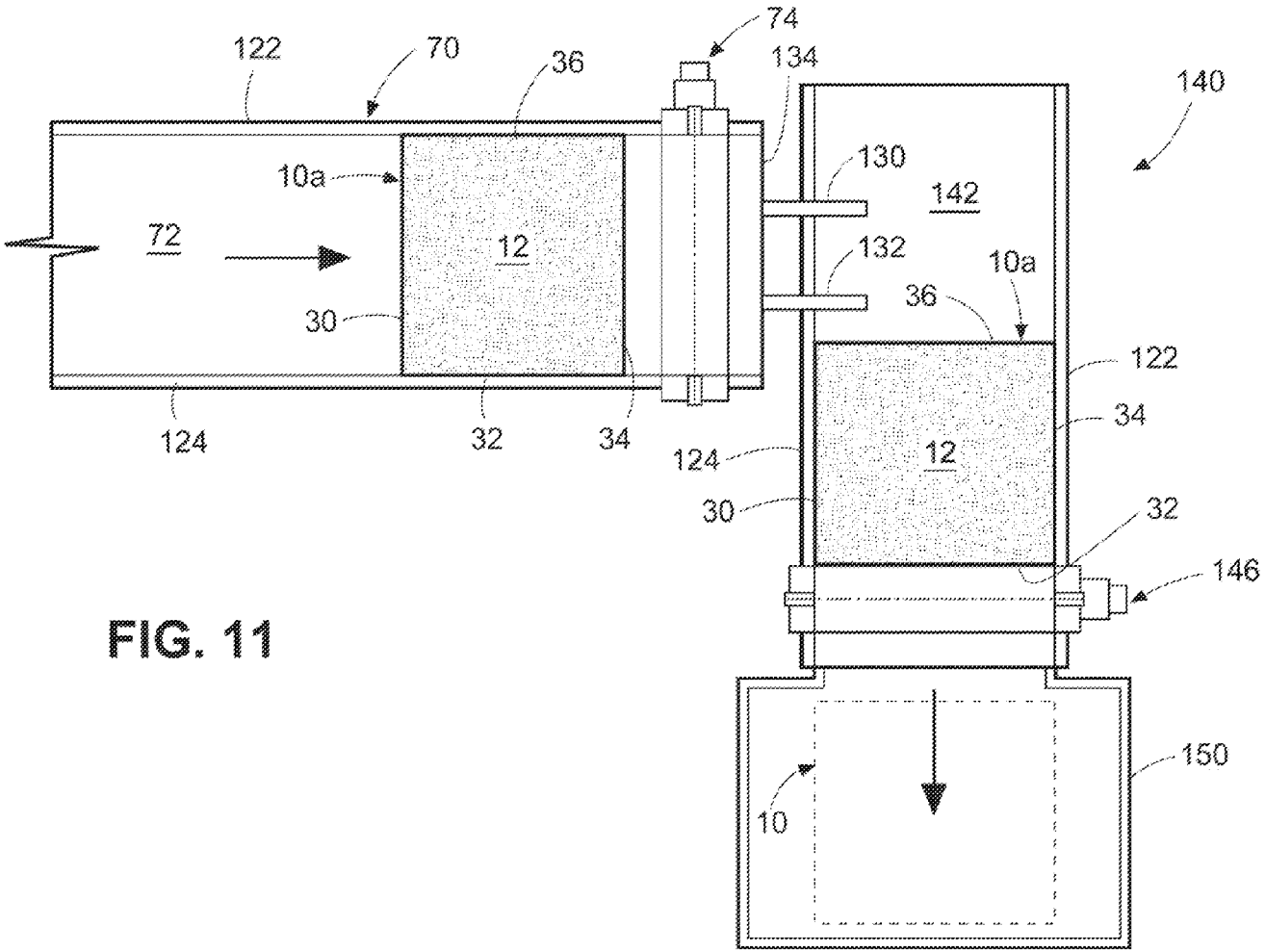
FIG. 11 is a simplified schematic view of a conveyor system for conveying beveled tile blanks through the roller assembly for forming surface declinations at the peripheral edges of the tile.

After beveling the edges of the tile blank 10*a*, the tile blank 10*a* is placed right-side up (FIG. 10C) with the top surface 12 facing upwardly, on a conveyor 70 (FIG. 11). The tile blank 10*a* is transported on a conveyor belt 72 through a roller assembly 74. The roller assembly 74 includes a cover frame 80 (FIG. 12) affixed to the conveyor 70 in any suitable known manner.

The cover frame 80 (FIG. 12) rotatably supports a roller 82 with spaced concave surfaces 84 and 86. The distance between the concave surfaces 84 and 86 of the roller 82 is slightly less than the distance 88 (FIG. 10C) between opposite edges 32 and 36 at the top side 12 of the beveled tile blank 10*a*.

Figure 12:
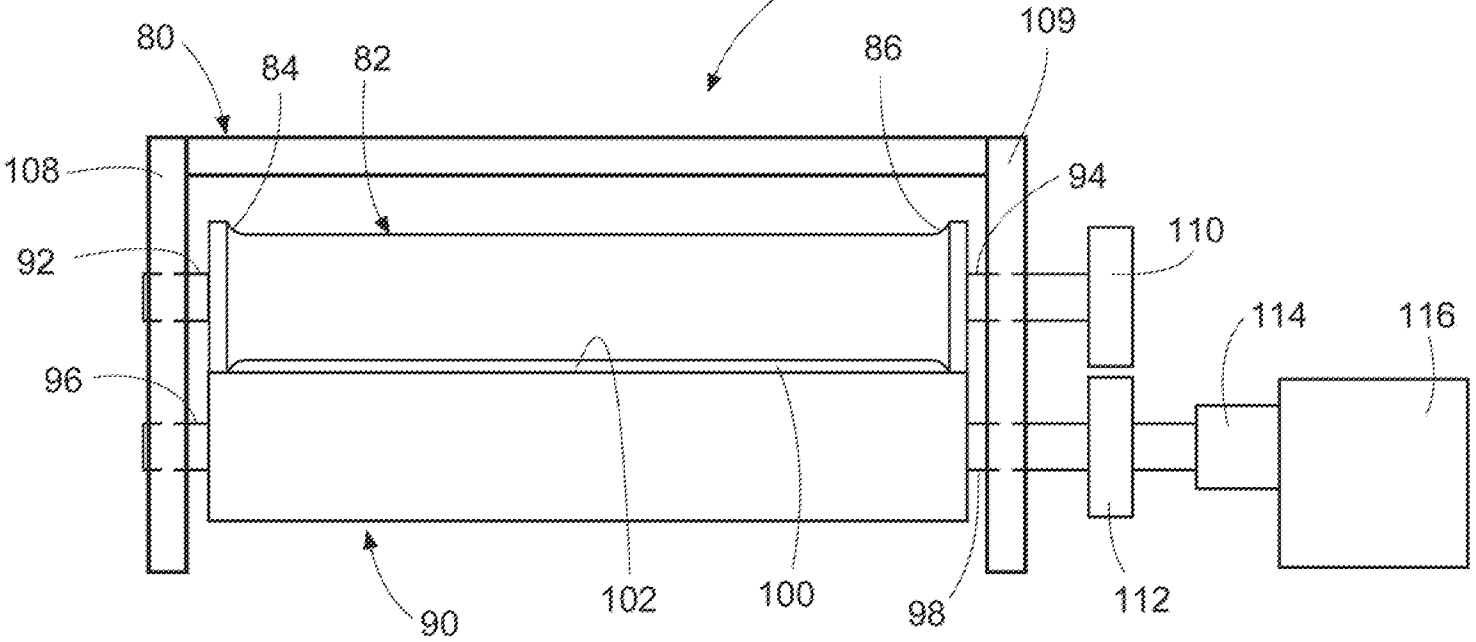
FIG. 12 is a simplified schematic view of the roller assembly of FIG. 11 for forming the surface declinations at the peripheral edges of the tile; and, FIGS. 13A-13D are simplified sectional views corresponding to FIGS. 10A, 10C, 10D and 10E showing the layer arrangement within the tile.

The roller 82 is mounted above a cylindrical roller 90 (FIG. 12). A top surface 102 of the cylindrical roller 90 is continuous with the conveyor belt 72 (FIG. 11). A tile space 100 (FIG. 12) between the rollers 82 and 90 is sized to closely accommodate the thickness of the tile blank 10*a*.

The rollers 82 and 90 (FIG. 12) are supported at opposite ends in sidewalls 108 and 109 of the cover frame 80 by roller bearings 92, 94 and 96, 98. The roller bearings 92, 94 and 96, 98 are positioned in the sidewalls 108 and 109 of the cover frame 80 to establish the predetermined tile space 100 between the rollers 82 and 90.

The roller bearings 94 and 98 (FIG. 12) are joined to gears 110 and 112, and the gear 112 is joined to a speed reducer 114 driven by a motor 116.

A plurality of beveled tile blanks 10*a* as shown in FIG. 10C are transported on the conveyor belt 72 (FIG. 11) one by one between conveyor rails 122 and 124 to the roller assembly 74. Since the distance between the concave surfaces 84 and 86 of the roller 82 (FIG. 12) is slightly less than the distance 88 (FIG. 10C) between opposite beveled edges 32 and 36 of the tile blank 10*a* there is interference between the concave surfaces 84 and 86 (FIG. 12) of the roller 82 and the beveled edges 32 and 36 of the tile 10*a* at the top surface 12 of the tile blank 10*a*.

Interference between the concave surfaces 84 and 86 of the roller 82 and the tile blank 10*a*, as shown schematically in exploded partial fragmentary section in FIG. 10D, enables the roller 82 to reform the beveled edge portions at the top surface 12 of the tile blank 10*a*, at two opposite sides of the tile blank 10*a*, to provide the rounded surface declinations 22 and 26 at the two opposite beveled edges 32 and 36 of the tile blank 10*a*.

The tile blank 10*a* (FIG. 11) is then conveyed over guide pieces 130 and 132 at an end 134 of the conveyor belt 72 onto a companion conveyor 140. The conveyor 140 is identical to the conveyor 70 but is oriented at an angle of 90° to the conveyor 70. The conveyor 140 is also at a lower level than the conveyor 70 such that the tile blank 10*a* on the conveyor belt 72 can drop from the guide pieces 130 and 132 of the conveyor 70 onto the conveyor belt 142 of the conveyor 140 (FIG. 11).

The conveyor 140 (FIG. 11) includes a roller assembly 146 identical to the roller assembly 74. Thus the conveyor belt 142 transports the tile blank 10*a* through the roller assembly 146 in a manner similar to that previously described for movement of the tile blank 10*a* through the roller assembly 74.

Under this arrangement the roller assembly 146 forms the rounded surface declinations 20 and 24 at the two opposite beveled edges 30 and 34 of the tile blank 10*a* thereby completing the rounded surface declinations 20, 22, 24 and 26 (FIG. 1) at all four sides of the tile 10.

The tile 10 with the rounded surface declinations and beveled edges is collected from the conveyor belt 142 (FIG. 11) in a collection bin 150. If desired the intersection 40 (FIG. 1) between the rounded surface declinations 20, 22, 24 and 26 and the beveled edges 30, 32, 34 and 36 can be finished in any suitable known manner such as grinding, to remove any roughness at the intersection 40.

During the formation of the rounded surface declinations for the tile blank there is no need to pre-heat the tile. Furthermore, because of the beveled profile of the tile blank 10*a*, the force required between the rollers 82 and 90 to form the rounded surface declinations at the top surface 12 is substantially less than what would be required to form a similar rounded surface declination on a tile blank without beveled edges.

Figure 2:
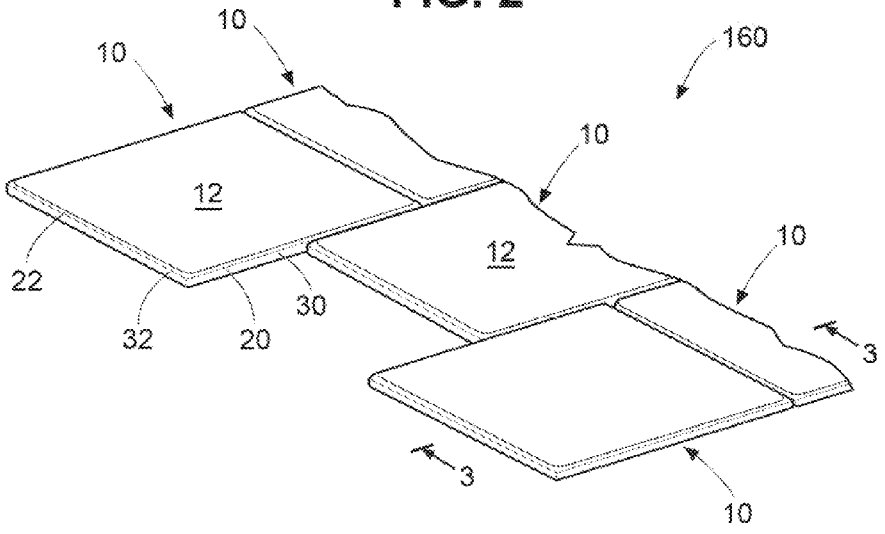
FIG. 2 is a perspective view of an assembly pattern thereof.

The tile 10 can be assembled with other similar tiles 10 in any selected assembly pattern on a floor base, such as the tile assembly pattern 160 of FIG. 2.

Any suitable known mastic or bonding material can be used to secure the lower surfaces 14 of the tiles 10 in the assembly pattern 160 to a floor base. The tiles 1.0 can be positioned to abut one another as shown in FIG. 3.

The only contact between abutting adjacent tiles 10 in the tile assembly 160 (FIG. 2) is at the intersection line 40 (FIG. 3) of each tile 10 where the curved surface declinations 20, 22, 24 and 26 intersect the beveled edge portions 30, 32, 34 and 36. Thus there is a very small contact area between abutting adjacent tiles 10.

Figure 3:
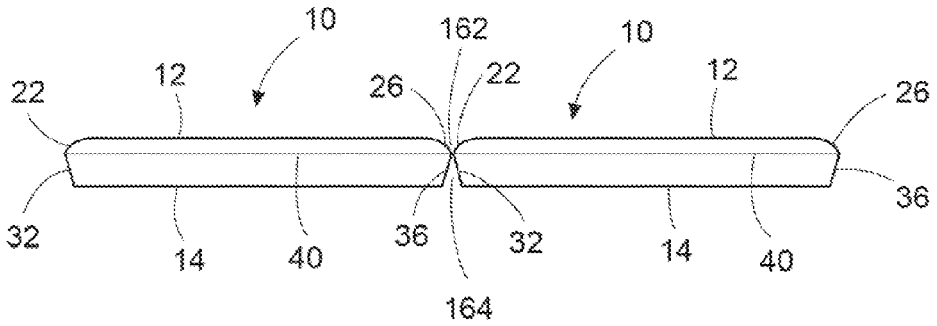
FIG. 3 is a sectional view taken on the line 3-3 of FIG. 2.

As will be noted from FIG. 3 there is a clearance space 162 between adjacent rounded surface declinations 22 and 26 of abutting adjacent tiles 10, and another clearance space 164 between adjacent beveled edge portions 32 and 36 of abutting adjacent tiles 10.

Any temperature related expansion of adjacent tiles 10 after installation on a floor base may cause compression of the edge portions of adjacent tiles 10 at abutting intersection lines 40 (FIG. 3). Relief of such compression can occur in the clearance spaces 162 and 164 between abutting tiles 10. Thus there is minimal likelihood of tile buckling after the tile installation on a floor base because of the pressure relief provided by the clearance spaces 162 and 164.

If desired the tiles 10 can be installed on a floor base with any suitable known grout material 170 (FIG. 4) provided between adjacent tiles 10. A space 166 (FIG. 4) between beveled edge portions 32 and 36 of adjacent tiles 10 defines an undercut because of the angle of divergence 42 (FIG. 10C) of the beveled edge portions 32 and 36. The space or undercut 166 locks the grout 170 between adjacent tiles 10. Since the grout 170 is locked into the undercut space 166 between adjacent tiles 10 there is little likelihood that such grout 170 will dislodge from the undercut space 166 between adjacent tiles 10.

Figure 10E:
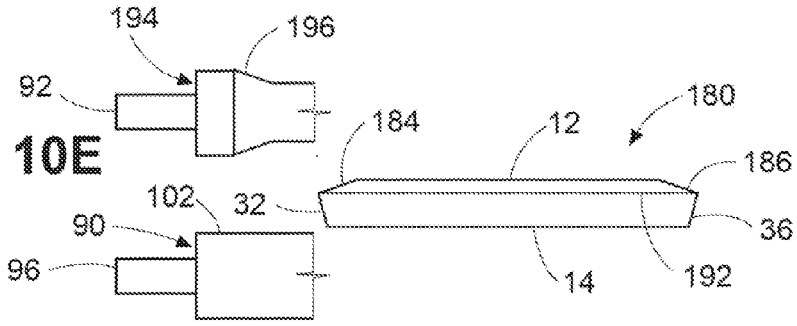
FIG. 10E is a view similar to FIG. 10D with a roller assembly in exploded simplified schematic fragmentary form for forming inclined, non-rounded surface declinations on the tile.

In another embodiment of the invention as shown in FIG. 10E a tile 180 has surface declinations 184 and 186 that are straight surface declinations rather than the curved or rounded surface declinations 22 and 26 shown in FIG. 10D.

The straight surface declinations 184 and 186 of the tile 180 incline downwardly from the horizontal top surface 12 to the beveled edges such as 32 and 36, and intersect with the beveled edges at an intersection line 192, at approximately ¼ to ⅓ the thickness of the tile 180 between the top surface 12 and the bottom surface 14.

The straight surface declinations, such as 182 and 184, are formed in a manner similar to the rounded or curved surface declinations 20, 22, 24 and 26. Thus a profiling roller 194 (FIG. 10E), similar to the profiling roller 82 (FIG. 10D), is provided with inclined portions such as 196.

A roller assembly of the rollers 194 and 90, is shown schematically in exploded partial fragmentary section in FIG. 10E and is similar to the roller assemblies 74 and 146. Thus the roller assemblies incorporating the rollers 194 and 90 are provided on conveyors similar to the conveyors 70 and 140 to form the inclined surface declinations such as 184 and 186. The roller assemblies incorporating the rollers 194 and 90 in FIG. 10E are similar to the roller assemblies 74 and 146 (FIGS. 11 and 12).

Figure 13D:
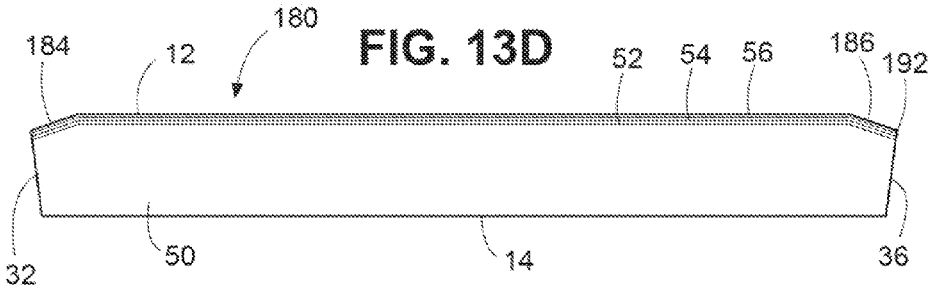

The inclined surface declinations such as 184 and 186 also include the top coat 56, the transparent wear layer 54 and the design layer 52 (FIG. 13D).

The tile 180 is otherwise similar to the tile 10.

Figure 5:
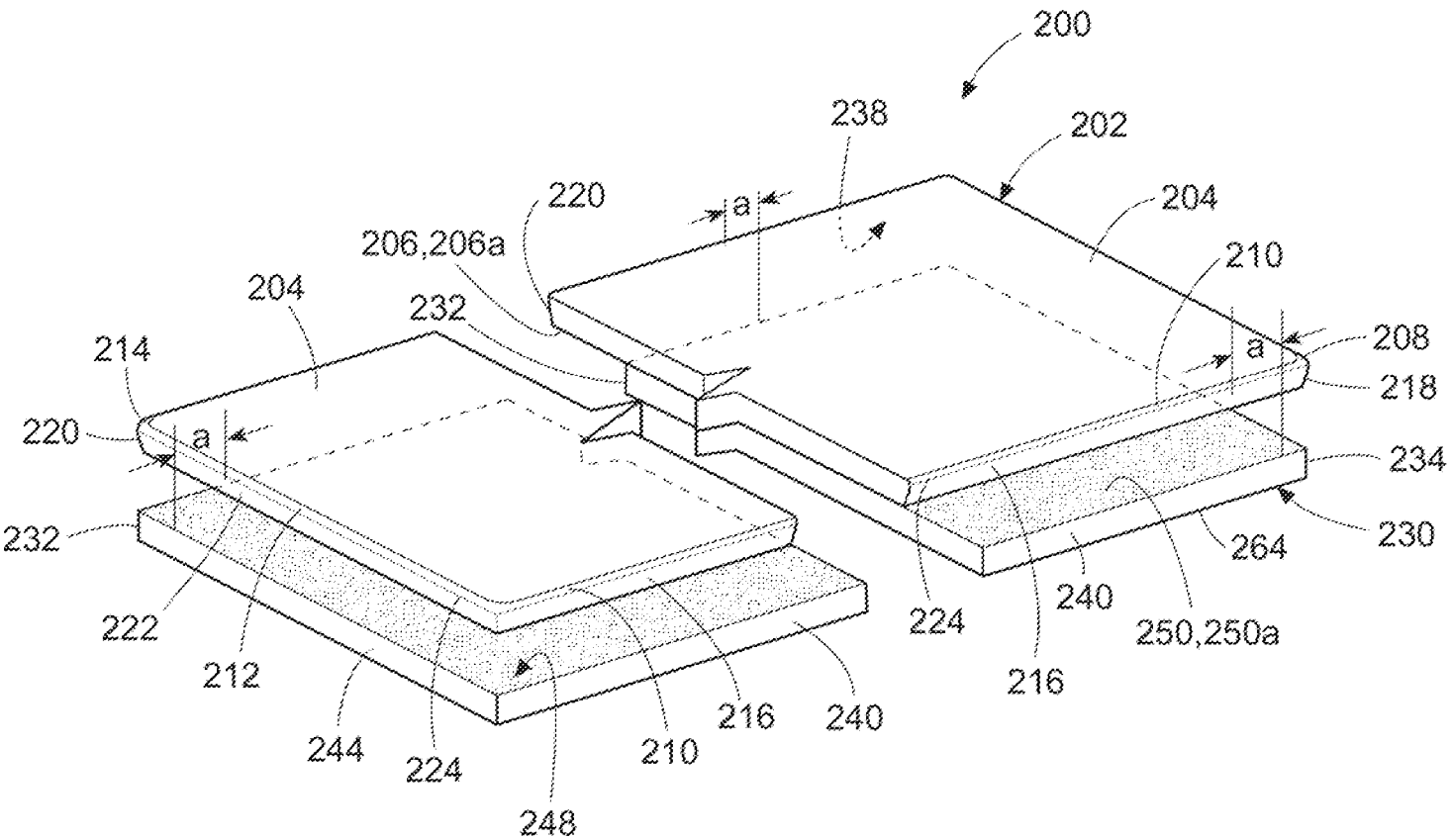
FIG. 5 is a broken perspective view of a floor plank incorporating another embodiment of the invention.

A floor member incorporating another embodiment of the invention is generally indicated by the reference number 200 in FIG. 5. The floor member 200 in this embodiment is a floor plank.

The floor plank 200 includes a first floor member portion 202 and a second floor member portion or underlayer portion 230 that are of identical size and shape. The first floor member portion 202 is laminated to the second floor member portion 230 such that the first floor member portion 202 has a predetermined offset from the second floor member portion 230 in the manner described in U.S. Pat. Nos. 7,155,871, 7,322,159, and 7,458,191, the disclosures of which are hereby incorporated by reference in this application.

The first floor member portion 202 is analogous to the floor tile 10 and includes a top surface 204, a bottom surface 206, rounded surface declinations 208, 210, 212 and 214 and beveled edge portions 216, 218, 220 and 222 and a line of intersection 224 between the rounded surface declinations and beveled edges corresponding to similarly described structure of the tile 10.

The first floor member portion 202 also includes a layer arrangement (not shown) of a base layer, design layer, transparent wear layer, and top coat similar to that of the layer arrangement 50, 52, 54 and 56 of the tile 10 (FIG. 13C). The first floor member portion is preferably formed as a completed separate entity before being laminated to the second floor member portion 230.

Preferably, but not necessarily, the second floor member portion 230 has no surface declinations or beveled edges.

In the offset arrangement of the first and second floor member portions 202 and 230, the bevel edge 220 (FIG. 5) of the first floor member portion 202 extends an offset amount "a" beyond a corresponding side edge 232 of the second floor member portion 230. Another beveled edge 218 of the first floor member portion 202, perpendicular to the beveled edge 220, extends the same offset amount "a" beyond a corresponding side edge 234 of the second floor member portion 230. The offsets at the side edges 220 and 218 thus define an offset L-shaped marginal section 238 (FIG. 5) of the first floor member portion 202.

Also in the offset arrangement of the first and second floor member portions 202 and 230, a side edge 240 (FIG. 5) of the second floor member portion 230 extends the offset amount "a" beyond the corresponding bevel edge 216 of the first floor member portion 202. Another side edge 244 of the second floor member portion 230, perpendicular to the side edge 240, extends the offset amount "a" beyond a corresponding bevel edge 222 of the first floor member portion 202. The offsets at the side edges 240 and 244 define an offset L-shaped marginal section 248 (FIG. 5) of the second floor member portion 230.

The L-shaped marginal section 238 of the first floor member portion 202 and the L-shaped marginal section 248 of the second floor member portion 230 are of identical size and shape.

Bonding material for laminating the first and second floor member portions 202 and 230 together can be provided on either the lower surface 206 of the first floor member portion 202 or an upper surface 250 of the second floor member portion 230. Under this arrangement only one of the L-shaped marginal sections 238 or 248 is provided with adhesive.

However, the bonding material for the laminated first and second floor member portions 202 and 230 is preferably provided on the lower surface 206 (FIG. 1) of the first floor member portion 202 and on the upper surface 250 of the second floor member portion 230.

The L-shaped marginal section 238 has a downwardly directed adhesive surface 206*a* (FIG. 5) that is part of the lower surface 206 of the first floor member portion 202 and the L-shaped marginal section 248 has an upwardly directed adhesive surface 250*a* (FIG. 5) that is part of the upper surface 250 of the second floor member portion 230. The adhesive on the exposed adhesive surfaces 206*a* and 250*a* is the bonding material used for laminating the first floor member portion 202 and the second floor member portion 230 together.

Although the dimensions of the floor plank 200 are a matter of choice, a suitable size for the first floor member portion 202 and the second floor member portion 230 can be, for example, 6 inches by 48 inches. Smaller or larger size floor planks are a matter of choice.

The thickness of the first floor member portion 202 can vary from about 2 to 5 mm, and the thickness of the second floor member portion 230 can vary from about 2 to 5 mm. The marginal offset "a" can be, for example, approximately 1 inch. The amount of offset "a" is a matter of choice, and larger or smaller offsets are also usable.

Figure 9:
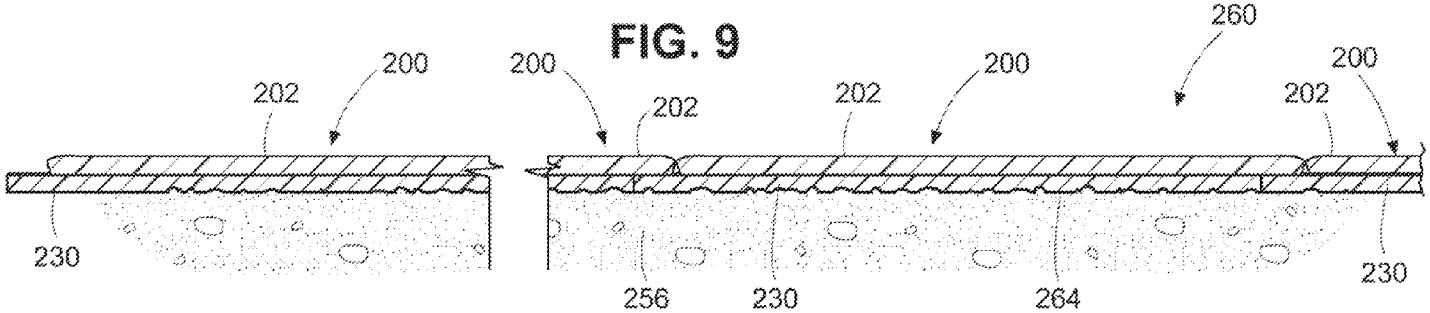
FIG. 9 is a sectional view similar to FIG. 8 but with the floor plank installed on a floor base.

As indicated in FIG. 9, the second floor member portion 230 of the floor plank 200 is yieldable to small bumps and other imperfections, generally referred to as surface irregularities in a floor base 256. The second floor member portion 230 thus enables the floor plank 200 to conform to such surface irregularities and lie flat on the floor base 256. The floor plank 200 is also sufficiently flexible, to conform to typical variations in surface contours of the floor base 256 upon which the floor plank 200 is laid.

Figure 6:
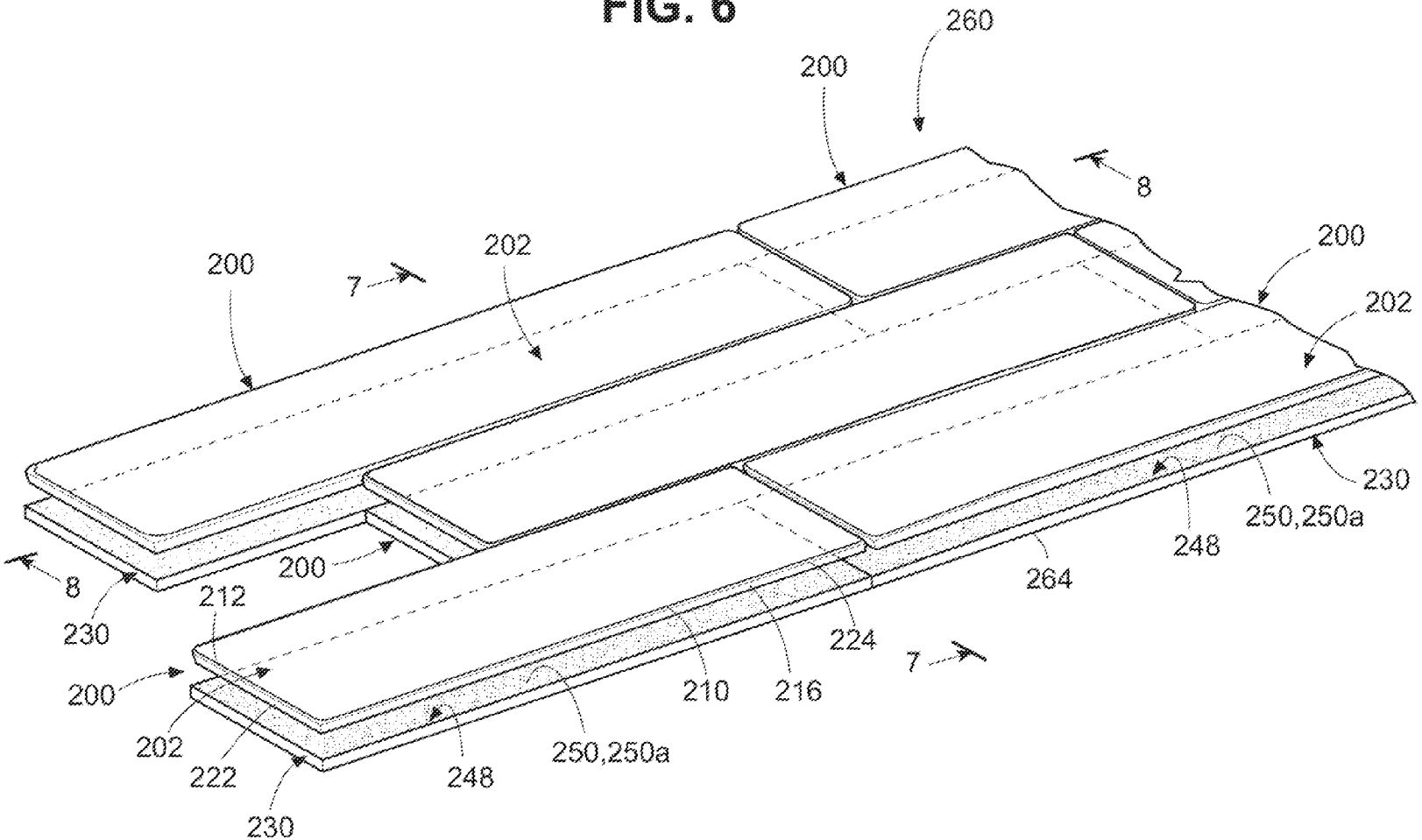
FIG. 6 is a perspective view of an assembly pattern thereof.
Figure 7:
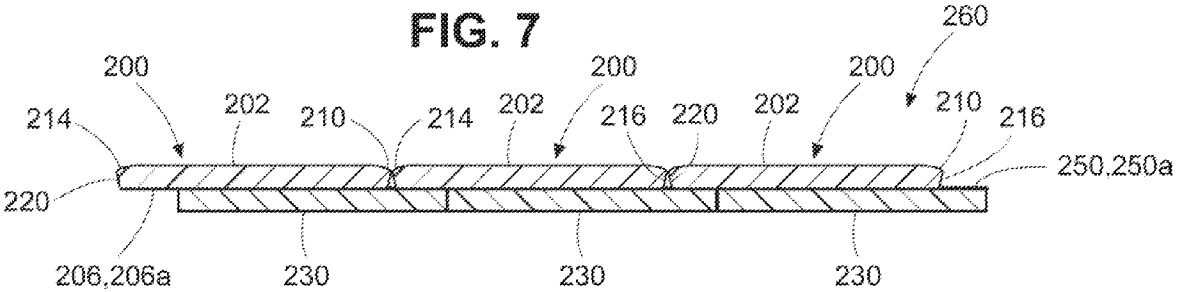
FIG. 7 is a sectional view taken on the line 7-7 of FIG. 6.
Figure 8:
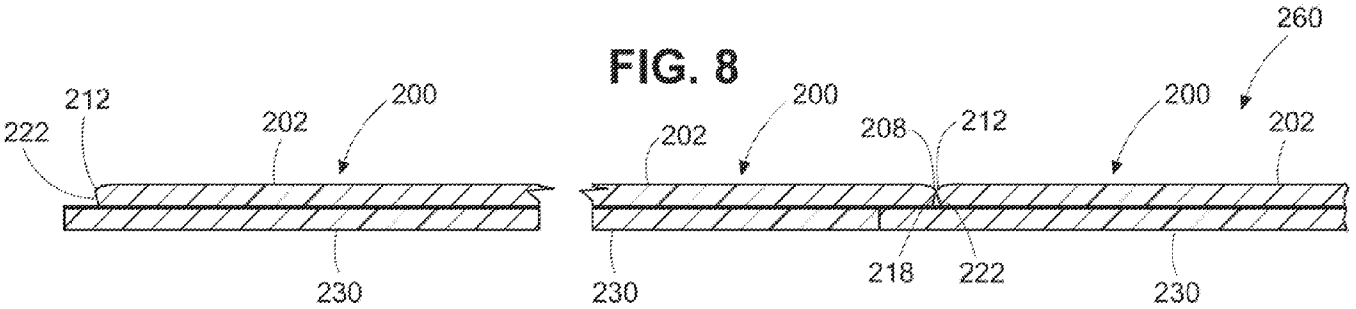
FIG. 8 is a sectional view taken on the line 8-8 of FIG. 6.

During installation of the floor planks 200 in side-by-side and end-to-end relationship, as shown in the floor plank assembly pattern 260 of FIG. 6, the downwardly directed adhesive surface 206*a* (FIG. 7) of the L-shaped marginal section 238 of the first floor member portion 202 is positioned to engage the upwardly directed adhesive surface 250*a* of the L-shaped marginal section 248 of the second floor member portion 230 to form the assembly 260 (FIGS. 6-8) of the floor planks 200.

When joining two of the planks 200 together, one of the planks 200 can be angled at approximately 45 degrees (not shown) with respect to the floor base 256 and onto the corresponding upwardly facing adhesive surface 250*a* (FIGS. 5-7) of an adjacent floor plank 200.

The thickness of the first and second floor member portions 202 and 230 enable the floor plank 200 to be bendable, when desired, with a predetermined convex bend or a predetermined concave bend to facilitate assembly of a plurality of the floor planks 200 into the floor plank assembly pattern 260 (FIG. 6).

The floor plank assembly pattern 260 (FIG. 6) is but one example of numerous possible plank assembly patterns known in the art.

The floor planks 200 can be installed on the floor base 256 (FIG. 9) without any mastic or adhesive coating on the floor base 256, and without mastic or adhesive on an undersurface 264 (FIG. 5) of the second floor member portion 230. Thus during installation, the floor planks 200 can be placed on a dry floor base surface 256 for easy shifting to any selected position, thereby facilitating installation of the floor planks 200 in any desired pattern or arrangement.

Preferably the installation of floor planks 200 should start in a corner of a room (not shown) and proceed outwardly therefrom. An expansion gap of ⅛ inch or less, for example, from each wall is generally suitable for most installations. The expansion gap is usually covered by wall molding.

The first floor member portion 202 and the second floor member portion 230 of the floor plank 200 are provided with an overall thickness that enables the floor plank 10 to be easily cut with a utility knife, if trimming is needed. Ease of trimming the floor plank 200 and the mastic free placement of the planks 200 on a floor base 256 make it convenient for a do-it-yourselfer to install the floor planks 200.

As with the floor tile 10 the first floor member portion 202 of the floor plank 200 has curved edge portions extending from the top surface and gradually declining at the peripheral edge to intersect with the beveled edge portions at an intersection line, resulting in a relatively small contact area between adjacent floor member portions 202, as previously described for the abutting tiles 10 in FIG. 3.

Thus if there is any expansion of adjacent floor member portions 202 after installation there is minimal likelihood of floor plank buckling because the expansion force of one floor plank against another can be relieved because of minimal surface contact and clearance spaces at adjacent beveled edge portions and adjacent surface declinations as previously described for the floor tile 10.

Figure 4:
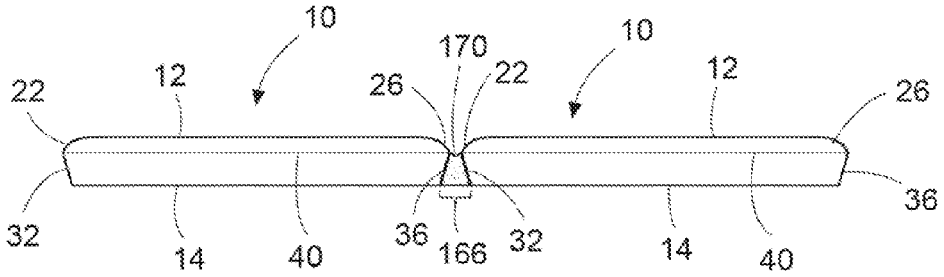
FIG. 4 is a sectional view similar to FIG. 3 but with grout provided between the tiles.

Also, if desired grout material can be provided between the first floor member portions 202 of adjacent floor planks 200 in a floor plank assembly, in a manner similar to that previously described for grouted floor tiles 10 in FIG. 4.

The floor plank 200 can also be formed with a square configuration as a floor tile and used in a manner similar to that previously described for the floor plank 200. As a further option the floor plank 200 or a corresponding floor tile can be formed with non-curved surface declinations corresponding to the straight surface declinations 184 and 186 of FIG. 10E.

As various changes can be made in the above constructions and methods without departing from the scope of the invention, it is intended that all matter contained in the above description or shown in the accompanying drawings shall interpreted as illustrative and not in a limiting sense.

What is claimed is:

1. A method of covering a floor surface comprising, a) forming a flexible floor member blank for a floor member unit such that the blank has a horizontal top surface for walking upon, a bottom surface for receiving a bonding material, a multi-sided polygonal periphery with at least two side edges, and a predetermined thickness between the horizontal top surface and the bottom surface, b) providing a beveled edge at the polygonal periphery to extend the full length of each side of the polygonal periphery of the floor member blank such that the beveled edge diverges from the bottom surface to the top surface, and the top surface and the beveled edge intersect at an acute angle, c) forming a surface declination at the peripheral edge of the blank where the top surface and the beveled edge intersect, such that the surface declination after being formed extends downwardly from the horizontal top surface a predetermined distance below the horizontal portion of the top surface such that the beveled edge intersects the surface declination at the predetermined distance below the horizontal portion of the top surface.

2. The method of claim 1 wherein the beveled edge is formed by grinding the polygonal edges of the tile.

3. The method of claim 1 wherein the profile of the surface declination is curved.

4. The method of claim 1 wherein the profile of the surface declination is straight and inclines downwardly from the horizontal portion of the top surface.

5. The method of claim 1 wherein the surface declination is formed by using a rotatable shaping tool with a pressure surface having the profile of the surface declination.

6. The method of claim 4 wherein the surface declination is formed by using a rotatable shaping tool with a pressure surface having the profile of the surface declination.

7. The method of claim 1 wherein the intersection between the surface declination and the beveled edge is finished to remove any sharp or rough edges that may be left after formation of the surface declination.

8. The method of claim 1 wherein the beveled edge is beveled to an angle of divergence of approximately 5° to 35° from a vertical axis in a direction from the bottom surface to the top surface.

9. The method of claim 1 further including, d) providing an underlayer portion having a multi-sided polygonal periphery of substantially the same size and shape as the floor member unit, with at least two side edges, and a lower surface constituting bottom surface of the floor member, e) laminating said floor member unit and said underlayer portion together in offset relationship from each other such that the offset of said floor member unit and said underlayer portion define a first offset marginal portion of said floor member unit, and a second offset marginal portion of said underlayer, and said first offset marginal portion of said floor member unit extends beyond at least one of the side edges of said underlayer portion, and said second marginal portion of said underlayer portion extends beyond at least one of the side edges of said floor member unit, and the first offset marginal portion has a first marginal lower surface, and the second offset marginal portion has a second marginal upper surface, f) providing at least one of the first marginal lower surface and the second marginal upper surface with an exposed adhesive coating, g) providing the floor member unit and the underlayer portion with respective predetermined thicknesses to enable the floor member to have a flexibility that permits said floor member to conform to surface contours of a floor base upon which the floor member is laid, and h) providing the underlayer portion with a predetermined yieldability to surface irregularities of a floor base upon which the floor member is laid such that the underlayer portion, when lying in flat contact on a floor base can conform to surface irregularities of the floor base.

10. A floor member comprising, a) a flexible floor member unit having a multi-sided polygonal periphery defining a polygonal edge, a top surface with a horizontal portion for walking upon, and a bottom surface for receiving a bonding material, b) said floor member unit having a surface declination at the top surface at the edge of the polygonal periphery extending the full length of each side of the polygonal periphery, said surface declination extending downwardly from the horizontal portion of the top surface a predetermined distance below the horizontal portion of the top surface, c) the polygonal edge of said floor member unit having a beveled edge portion extending the full length of each side of the polygonal periphery, said beveled edge portion diverging upwardly from the bottom surface toward the top surface, said surface declination intersecting the beveled edge portion along a line at the predetermined distance below the horizontal portion of the top surface, and the floor member unit in an upward direction from the bottom surface has a base layer, a design layer, and a wear layer, and the surface declination includes the design layer and the wear layer.

11. The floor member as claimed in claim 10, said floor member unit having a predetermined thickness between the horizontal portion of the top surface and the bottom surface, and the intersection between the surface declination and the beveled edge portion is at approximately ¼ to ⅓ the thickness of the floor member unit as measured from the horizontal portion of the top surface.

12. The floor member as claimed in claim 10, wherein the beveled edge portion has an angle of divergence of approximately 5® to 35° from a vertical axis in a direction from the bottom surface to the top surface.

13. The floor member as claimed in claim 10, wherein the wear layer is transparent and the design layer has a printed design that is visible through the transparent wear layer.

14. The floor member as claimed in claim 12, wherein the base layer, design layer and wear layers are formed with polyvinyl chloride.

15. The floor member as claimed in claim 10, wherein the floor member unit has a thickness from the bottom surface to the horizontal portion of the top surface of approximately 2 to 5 mm.

16. The floor member as claimed in claim 10, wherein the floor member unit is selected from the group consisting of a floor tile and a floor plank.

17. The floor member as claimed in claim 10, wherein the surface declination has a curved profile.

18. The floor member as claimed in claim 10, wherein the surface declination has a straight profile.

19. The floor member as claimed in claim 10, wherein said floor member unit has at least two side edges, said floor member further including, d) an underlayer portion having a multi-sided polygonal periphery of substantially the same size and shape as the floor member unit, with at least two side edges, and a lower surface constituting a bottom surface of the floor member, e) said floor member unit and said underlayer portion being laminated together in offset relationship from each other, f) the offset of said floor member unit and said underlayer portion defining a first offset marginal portion of said floor member unit, and a second offset marginal portion of said underlayer, said first offset marginal portion of said floor member unit extending beyond at least one of the side edges of said underlayer portion, and said second marginal portion of said underlayer portion extending beyond at least one of the side edges of said floor member unit, g) said first offset marginal portion having a first marginal lower surface and said second offset marginal portion having a second marginal upper surface, and at least one of the first marginal lower surface and the second marginal upper surface having an exposed adhesive coating, h) the floor member unit and the underlayer portion having respective predetermined thicknesses to enable the floor member to have a flexibility that permits said floor member to conform to surface contours of a floor base upon which the floor member is laid, and i) the underlayer portion having a predetermined yieldability to surface irregularities of a floor base upon which the floor member is laid such that the underlayer portion, when lying in flat contact on a floor base can conform to surface irregularities of the floor base.

* * * * *

UNITED STATES PATENT AND TRADEMARK OFFICE

CERTIFICATE OF CORRECTION

PATENT NO. : 8,733,063 B2
APPLICATION NO. : 13/349179
DATED : May 27, 2014
INVENTOR(S) : Jincheng Song et al.

It is certified that error appears in the above-identified patent and that said Letters Patent is hereby corrected as shown below:

In the Specification:

Column 4
Line 29, change "1.0" to --10--.

In the Claims:

Column 8
Line 37, after "constituting" insert --a--.

Column 9
Line 31, change "5®" to --5°--.

Signed and Sealed this
Second Day of September, 2014

Michelle K. Lee

Michelle K. Lee
*Deputy Director of the United States Patent and Trademark Office*